US012662290B2

(12) United States Patent
Mattioli

(10) Patent No.: US 12,662,290 B2
(45) Date of Patent: Jun. 23, 2026

(54) METHOD FOR MANUFACTURING A CAPSULE MADE OF ALUMINUM FOR SMALL TUBES WITH OPEN HOLE AND PRODUCT SO OBTAINED

(71) Applicant: D.B.N. TUBETTI S.R.L., Anzio (IT)

(72) Inventor: Maurizio Mattioli, Anzio (IT)

(73) Assignee: D.B.N. TUBETTI S.R.L., Anzio (IT)

( * ) Notice: Subject to any disclaimer, the term of this patent is extended or adjusted under 35 U.S.C. 154(b) by 41 days.

(21) Appl. No.: 18/555,481

(22) PCT Filed: Apr. 4, 2022

(86) PCT No.: PCT/IB2022/053103

§ 371 (c)(1),
(2) Date: Oct. 13, 2023

(87) PCT Pub. No.: WO2022/219453

PCT Pub. Date: Oct. 20, 2022

(65) Prior Publication Data

US 2024/0199284 A1 Jun. 20, 2024

(30) Foreign Application Priority Data

Apr. 15, 2021 (IT) ..... 102021000009485

(51) Int. Cl.
*B21D 51/50* (2006.01)
*B65D 35/44* (2006.01)
*B65D 41/04* (2006.01)

(52) U.S. Cl.
CPC ..... *B65D 41/045* (2013.01); *B21D 51/50* (2013.01); *B65D 35/44* (2013.01)

(58) Field of Classification Search
CPC .... B21D 51/365; B21D 51/443; B21D 51/46; B21D 51/50; B21D 51/44; B65D 35/44; B65D 41/045
See application file for complete search history.

(56) References Cited

U.S. PATENT DOCUMENTS 1,803,022 A * 4/1931 Kowal ..... B21D 51/50 72/356
2,141,602 A * 12/1938 Friden ..... B21D 51/36 72/340

(Continued)

FOREIGN PATENT DOCUMENTS

GB 1598428 A 9/1981

OTHER PUBLICATIONS

Aluminum 3004, material data sheet, retrieved from internet May 28, 2025.*

(Continued)

*Primary Examiner* — Edward T Tolan
(74) *Attorney, Agent, or Firm* — NIXON & VANDERHYE

(57) ABSTRACT

Capsule made of aluminum, suited to seal small tubes with open hole by using a capsule made of the same metallic material as the tube, the capsule being useful in the recycling of its materials after their end use; the capsule including: a cylindrical body made of aluminum, derived from the pressure received from the punch during cavity formation; a thread, imparted within the wall of the capsule, in turn imparting a thread on the outlet of the present small tube with open hole; at least a seal, installed on the internal side of the upper face of the capsule, isolating the product contained within the small tube and to increase the sealing properties of the package; and at least a lower band, adapted to represent a security seal so as to distinguish the capsules that have already been unscrewed from those that are still new.

17 Claims, 2 Drawing Sheets

(56) References Cited

U.S. PATENT DOCUMENTS

| | | | | | |
|---|---|---|---|---|---|
| 2,322,885 | A * | 6/1943 | Rogers | B21D 51/365 | 222/542 |
| 2,429,376 | A * | 10/1947 | Stagmeier | B31B 70/00 | 264/318 |
| 2,864,521 | A * | 12/1958 | Kundert | B65D 41/3409 | 215/252 |
| 3,217,397 | A | 11/1965 | Voss | | |
| 4,416,142 | A * | 11/1983 | Thorne-Thomsen | B21D 51/50 | 470/84 |
| 4,530,437 | A * | 7/1985 | Gray | B65D 41/3457 | 29/451 |
| 4,893,718 | A | 1/1990 | Delespaul | | |
| 6,305,210 | B1 * | 10/2001 | Saunders | B21D 22/201 | 72/348 |
| 10,358,282 | B1 * | 7/2019 | Strickler | B65B 19/12 | |
| 2005/0269283 | A1 * | 12/2005 | Ribi | B65D 41/045 | 220/255 |

OTHER PUBLICATIONS

WO 2014/033619A2, Stokes et al. Mar. 2014.*
International Search Report and Written Opinion of the ISA for PCT/IB2022/053103 mailed Jul. 12, 2022, 9 pages.

* cited by examiner

METHOD FOR MANUFACTURING A CAPSULE MADE OF ALUMINUM FOR SMALL TUBES WITH OPEN HOLE AND PRODUCT SO OBTAINED

CROSS-REFERENCE TO RELATED APPLICATIONS

This application is the U.S. national phase of International Application No. PCT/IB2022/053103 filed Apr. 4, 2022, which designated the U.S. and claims priority to IT 102021000009485 filed Apr. 15, 2021, the entire contents of each of which are hereby incorporated by reference.

TECHNICAL FIELD

The invention relates to an innovative method for manufacturing capsules made of aluminum suited to seal the usual small tubes made of aluminum thereby ensuring a complete eco-sustainability for the packaging, which can be recycled in its entirety due to its being entirely of aluminum.

BACKGROUND ART

In the packaging sector, and beyond, packages made of small tubes are becoming more and more widespread. Said packages provide to stow the materials to be sold/commercialized within appropriate small tubes made of aluminum, the latter being closed by means of suitable seals, gaskets and capsules.

The packaging of products within small tubes made of aluminum allows the seller to comply with all rules related to hygiene and product preservation, by largely reducing costs due to the purchase of various materials and machines suited to sanitize and to create/apply a manmade protective gas.

On the other hand, on the client side, the fact of eating/consuming products preserved inside small tubes implies a reduction of waste and promotes an optimal preservation of the product during transportation, by eliminating infiltrations from the environment.

In addition, the aluminum used to manufacture these small tubes is also recyclable and this is an advantage of utmost importance in the packaging sector.

However, to date a problem still to be solved is a method for closing said small tubes of aluminum. Actually, plastic-made capsules are used but they cannot be recycled together with the small tube due to the fact that they are made of a different material.

Given their shape, these plastic-made capsules are easy to mold but they do not meet the needs of a market which more and more aims at environmental friendliness.

Moreover, plastic-made capsules commonly used nowadays have several drawbacks, among others a poor resistance to high temperatures.

If the product is to be preserved at temperatures exceeding 100° C., then any kind of plastic-made capsule implies the risk of a dispersion of small particles or fragments which pollute the packaged product. For this reason it will be necessary to prefer cold packaging processes, thereby affecting the market.

Among previously filed applications or patents, for instance U.S. Pat. No. 4,893,718, there do not exist solutions to these problems apart from a technique for separating the package into several parts before their recycling.

Therefore, it is an object of the present invention to solve the abovementioned problems by providing a method for manufacturing capsules of aluminum suited to seal the common small tubes with open hole.

DESCRIPTION OF THE INVENTION

According to the present invention there is provided a method for manufacturing a capsule made of aluminum for small tubes with open hole, that reliably solves the abovementioned problems.

The present manufacturing method provides a new type of capsules made of aluminum suited to seal small tubes with open hole, simplifying in this way the processes of recycling and waste disposal because the entire package is made of aluminum. The so obtained capsule comprises a cylindrical body that confers rigidity to the capsule. The cylindrical body is obtained by means of a drawing process in which all geometrical dimensions are implemented and specified.

In one embodiment, said aluminum capsule demands a thickness some millimeter larger than usual for the nozzle/outlet of the small tube, in order to improve the seal effectiveness/reliability.

The present aluminum capsule comprises in its interior a thread suited to form a complementary thread on the outlet/nozzle of the small tube in order to improve the sealing effect.

A seal is inserted internally in the cavity of the capsule, which is suited to hermetically seal the package and to avoid any kind of infiltration from the outside environment.

Finally, a lower band is installed inferiorly on said aluminum capsule, in order to realize a security/warranty seal for distinguishing new capsules from those already opened and therefore used.

The present method involving the manufacture of capsules made of aluminum for small tubes with open hole starts with an initial examination of the physical properties of treated aluminum, through an analysis of its elasticity as well as of its resistance to heat and deformation.

Thereafter, an aluminum sheet is stretched/extended and engaged within a die adapted to hold in place the aluminum sheet during pressing.

The deformation of the aluminum sheet is performed using a punch adapted to impart a cavity, so as to create said aluminum capsule. In one embodiment, said punch is adapted to impart a round and flat shape to the upper face of the capsule, for the purpose of augmenting adherence of the capsule to the open hole of the small tube.

In an illustrative and non-limitative embodiment, a conical shape may be given to said capsule, wherein the walls of its cylindrical body are slightly convergent at the upper end for improving the sealing effectiveness.

During the aluminum sheet deformation step required to create the cavity which will give rise to the aluminum capsule, said thread is further impressed/engraved in the interior of the capsule. This step is deemed essential in order to form later on, by impression, a thread on the nozzle/outlet of the small tube when the capsule is screwed in order to seal the package.

Quality control is carried out randomly on one of the capsules after their manufacture.

The insertion of a food grade membrane seal that adheres to the inner upper part of the capsule is adapted to isolate the packaged product within the small tube from the outside environment.

Said seal, even if made of non-metal material, is suited for recycling together with the entire small aluminum tube since it constitutes less than 0.4% of the entire package.

According to one embodiment, said seal is made of food grade (that is, food contact) silicone material, for the purpose of not altering the properties of the materials contained inside the package.

Finally, a lower band is installed which is adapted to represent a security seal, so as to distinguish new small tubes from those already opened.

The advantages offered by the present invention are obvious in the light of the foregoing description and they will be even clearer when reference is made to the accompanying figures and to the detailed description.

DESCRIPTION OF DRAWINGS

The invention will be described in at least one preferred embodiment, for illustrative and non-limitative purposes, with reference to the annexed Figures, in which.

DETAILED DESCRIPTION OF THE INVENTION

The present invention will now be described only for illustrative, but non-limitative or binding purposes, with reference to the accompanying drawings which show some embodiments of the present inventive concept.

Figure 1:
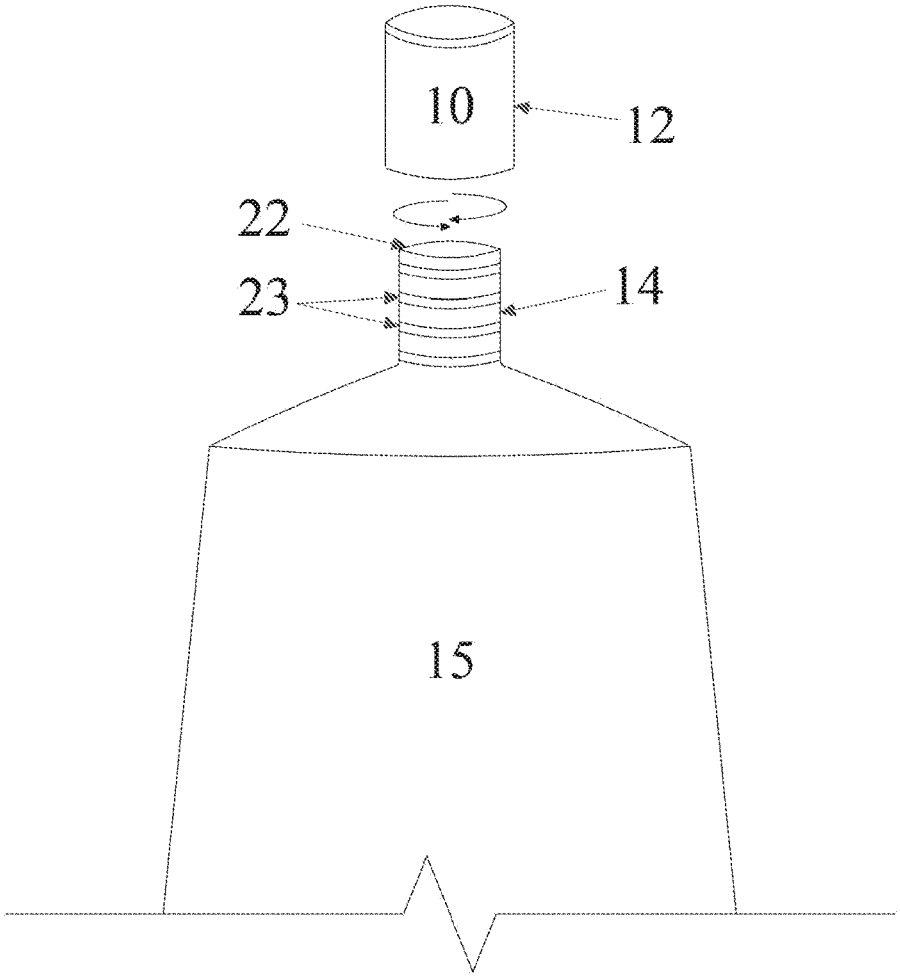
FIG. 1 shows the details of a small tube 15 with open hole 22 sealed by a capsule 10 made of aluminum. This capsule 10 comprises a cylindrical body made of aluminum, suited to facilitate the recycling of the entire package after use of the product. This small tube 15 comprises a nozzle or outlet 14 on which a plurality of threads 23 are indicated, which are engraved/etched by the capsule 10 during the first screwing operation.

Turning attention to FIG. 1 it shows a schematical representation of a typical use of a capsule 10 made of aluminum.

The capsule 10 is used to seal small tubes 15 which have an open hole 22 on their nozzle/outlet 14.

The cylindrical body 12 of the capsule 10 is suited to impart/engrave a thread 23 on this outlet 14 during the first screwing operation.

Due to the fact that the capsule 10 is entirely made of aluminum, the whole package assembly is eco-sustainable since it is easily recyclable. Aluminum is in fact one among the most recyclable materials due to its physical properties.

Figure 2:
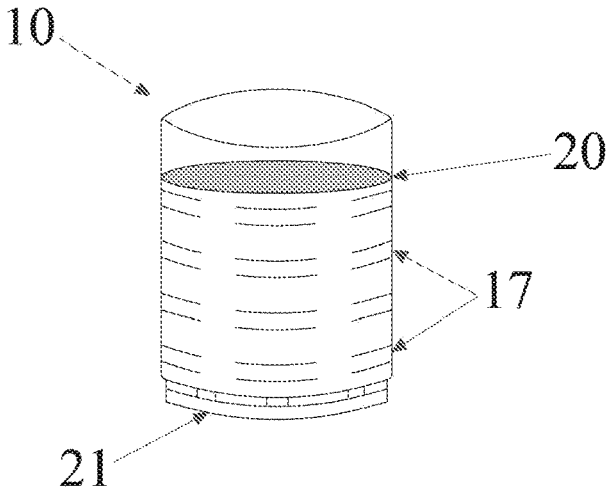
FIG. 2 shows in greater detail the configuration of the capsule 10 made of aluminum, suited to seal a common small tube of aluminum 15 with open hole 22. This capsule 15 includes in its interior a seal 20, that is a membrane for food products, suited to seal with greater effectiveness/reliability the content of the small tube 15. A thread 17 is imparted during the drawing steps in which a punch forms the capsule 10 starting from a common aluminum sheet. A band 21 is mounted inferiorly on said capsule 10 in order to distinguish a new capsule 10 from one which has been already opened, thereby representing the security seal of the package.

Referring to FIG. 2, it shows an internal view of the aluminum capsule 10.

The thread 17 is suited to engrave/impart the first thread 23 on the nozzle or outlet 14 of the small tube 15.

A seal 20, preferably made of a food grade membrane, is inserted within the capsule 10 in order to increase its sealing properties with regard to the product packaged in the small tube 15. Said seal 20, even if non-metallic, can be recycled together with the whole of the small aluminum tube 15 because it amounts to less than 0.4% of the entire package.

On its lower side, the capsule 10 has a visible lower band 21 which functions as a warranty seal to identify a new capsule 10 and distinguish it from an opened one upon unscrewing.

Figure 3:
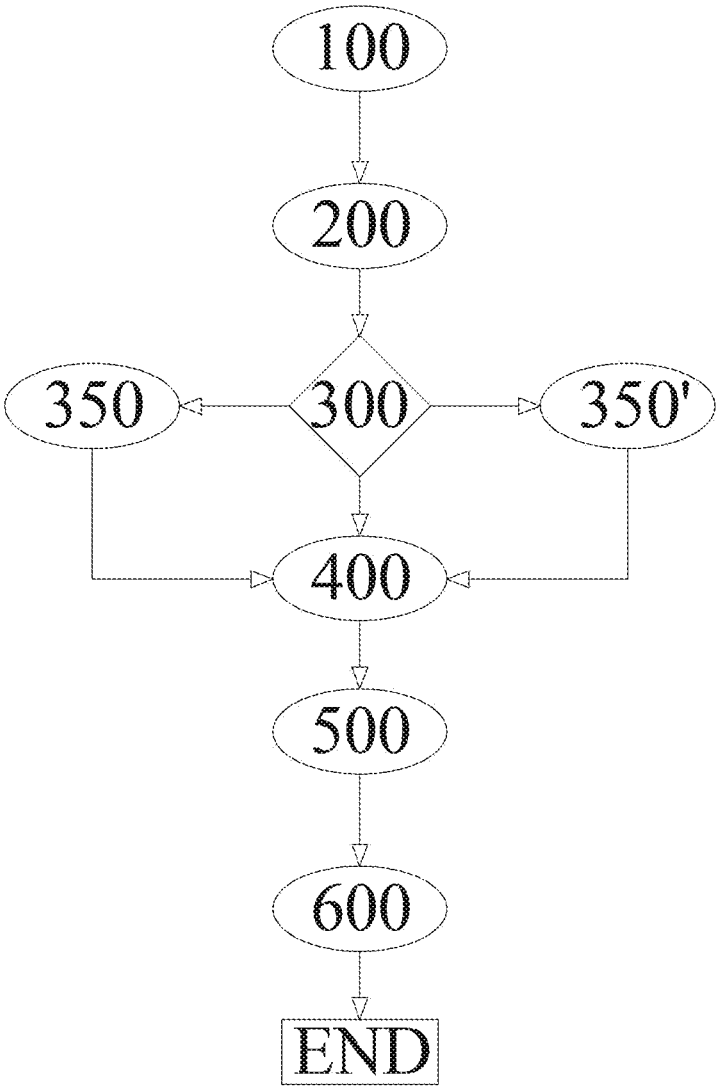
FIG. 3 shows the flowchart embodying the method of the present invention which is linked to the product obtained therefrom.

FIG. 3 is a representation of a flowchart of the method allowing to obtain said capsule 10 made of aluminum, for small tubes 15 with open hole 22, which includes the following steps:

- study 100 of the physical properties of treated aluminum, by means of analysis of elasticity and heat and deformation resistance;
- extending 200 an aluminum sheet, engaged within a die adapted to maintain said aluminum sheet in position during pressing;
- deformation 300 of the aluminum sheet by means of a punch, adapted to impart a cavity, creating said aluminum capsule 10;
- quality control 400 carried out randomly on one of the manufactured capsules 10;
- insertion 500 of a food membrane seal 20, which is adherent with the upper internal part of the capsule 10, adapted to isolate the packaged product within the small tube 15 from the outside environment; said seal 20, even if made of non-metal material, is adapted to be recycled together with the entire small aluminum tube 15 since it constitutes less than 0.4% of the entire package;
- installation 600 of a lower band 21, adapted to represent the security seal, so as to identify the small tubes 15 that are still new and those already opened.

Lastly, it is clear that changes may be made to the invention, as described so far, and even additions or variants obvious for a skilled person are possible, without in this way departing from its scope as defined in the appended claims.

The invention claimed is:

1. A method for manufacturing a capsule made of aluminum, for a small tube with an open hole, the capsule and small tube forming an aluminum package, the capsule adapted to seal the small tube by using the same aluminum construction material employed in making the small tube, so that the small tube is a small aluminum tube and so as to render all of the aluminum package eco-sustainable, the method comprising:

- studying physical properties of treated aluminum, using analysis of elasticity and heat and deformation resistance;
- extending an aluminum sheet, engaged within a die to maintain said aluminum sheet in position during pressing;
- deforming the aluminum sheet using a punch, to impart a cavity, creating said aluminum capsule with a cylindrical body, the cylindrical body derived from pressure received from the punch during formation of the cavity;
- carrying out quality control randomly on one of the manufactured capsules;
- inserting a food membrane seal, which is adherent with an upper internal part of the capsule and constitutes less than 0.4% of the entire aluminum package, to isolate the packaged product within the small tube from outside environment; said food membrane seal being adapted to be recycled together with all of the small tube since the food membrane seal constitutes less than 0.4% of the entire aluminum package; and mounting a visible lower band inferiorly on said capsule in order to distinguish a new capsule from an already open capsule, the lower band being visible so as to realize a warranty seal to identify the capsule as being new and, upon unscrewing the small tube from the capsule, to identify the capsule as having been already opened, so as to identify whether the small tube is still new and whether the small tube has previously been opened.

2. The method for manufacturing the capsule made of aluminum for the small tube with the open hole, according to claim 1, wherein said punch is adapted to impart a round and flat shape to an upper face of the capsule.

3. The method for manufacturing the capsule made of aluminum for the small tube with the open hole, according to claim 1, wherein said capsule is attained by pressure of a punch, adapted to make a capsule with conical shape, improving the sealing capacity thereof.

4. The method for manufacturing the capsule made of aluminum for the small tube with the open hole, according to claim 1, wherein during the step of deformation of the aluminum sheet, a thread is imparted within the capsule, for the purpose of subsequently imparting the thread to an outlet of the small tube by impression, when said capsule is screwed for sealing the aluminum package the first time.

5. The method for manufacturing the capsule made of aluminum for the small tube with the open hole, according to claim 1, wherein said seal is made of food silicone material.

6. A capsule made of aluminum for small tubes with open hole, said capsule being manufactured using the manufacturing method of claim 4, in order to seal the small tubes with the open hole, said capsule comprising:

the cylindrical body made of aluminum, derived the pressure received from the punch during cavity formation;

the thread, imparted within the wall of said capsule, in turn adapted to impart the thread on the outlet of the present small tube with the open hole;

the food membrane seal, installed on the internal side of the upper face of the capsule, adapted to isolate the product contained within the small tube and to increase the sealing properties of the package; and the visible lower band, adapted to represent the warranty seal so as to distinguish the capsules that have already been unscrewed from those that are still new.

7. The method for manufacturing the capsule made of aluminum for the small tube with the open hole, according to claim 2, wherein said capsule is attained by pressure of a punch, adapted to make a capsule with conical shape, improving the sealing capacity thereof.

8. The method for manufacturing the capsule made of aluminum for the small tube with the open hole, according to claim 2, wherein during the step of deformation of the aluminum sheet, a thread is imparted within the capsule, for the purpose of subsequently imparting the thread to an outlet of the small tube by impression, when said capsule is screwed for sealing the aluminum package the first time.

9. The method for manufacturing the capsule made of aluminum for the small tube with the open hole, according to claim 3, wherein during the step of deformation of the aluminum sheet, a thread is imparted within the capsule, for the purpose of subsequently imparting the thread to an outlet of the small tube by impression, when said capsule is screwed for sealing the aluminum package the first time.

10. The method for manufacturing the capsule made of aluminum for the small tube with the open hole, according to claim 7, wherein during the step of deformation of the aluminum sheet, a thread is imparted within the capsule, for the purpose of subsequently imparting the thread to an outlet of the small tube by impression, when said capsule is screwed for sealing the aluminum package the first time.

11. The method for manufacturing the capsule made of aluminum for the small tube with the open hole, according to claim 2, wherein said seal is made of food silicone material.

12. The method for manufacturing the capsule made of aluminum for the small tube with the open hole, according to claim 3, wherein said seal is made of food silicone material.

13. The method for manufacturing the capsule made of aluminum for the small tube with the open hole, according to claim 4, wherein said seal is made of food silicone material.

14. The method for manufacturing the capsule made of aluminum for the small tube with the open hole, according to claim 7, wherein said seal is made of food silicone material.

15. The method for manufacturing the capsule made of aluminum for the small tube with the open hole, according to claim 8, wherein said seal is made of food silicone material.

16. The method for manufacturing the capsule made of aluminum for the small tube with the open hole, according to claim 9, wherein said seal is made of food silicone material.

17. The method for manufacturing the capsule made of aluminum for the small tube with the open hole, according to claim 10, wherein said seal is made of food silicone material.

* * * * *